US007338229B1

(12) United States Patent
Kuo

(10) Patent No.: US 7,338,229 B1
(45) Date of Patent: Mar. 4, 2008

(54) TRAFFIC CONE COUNTERWEIGHT STRUCTURE

(75) Inventor: Shu-Nan Kuo, Ho Mei Township, Changhua County (TW)

(73) Assignee: Jing Nan Traffic Engineering Co., Ltd., Changhua County (TW)

( * ) Notice: Subject to any disclaimer, the term of this patent is extended or adjusted under 35 U.S.C. 154(b) by 0 days.

(21) Appl. No.: 11/682,444

(22) Filed: Mar. 6, 2007

(51) Int. Cl.
*E01F 9/012* (2006.01)
*E01F 9/00* (2006.01)

(52) U.S. Cl. ..... 404/9; 116/63 C

(58) Field of Classification Search ..... 404/6, 404/9, 10; 116/63 C, 63 R, 63 T
See application file for complete search history.

(56) References Cited

U.S. PATENT DOCUMENTS 3,809,007 A * 5/1974 Brown ..... 116/63 P
4,018,025 A * 4/1977 Collette ..... 52/302.4
5,199,813 A * 4/1993 Nagler ..... 404/9
5,421,668 A * 6/1995 Cowan et al. ..... 404/6
5,630,675 A * 5/1997 Boeger ..... 404/6
5,868,520 A * 2/1999 Kulp et al. ..... 404/6
6,109,820 A * 8/2000 Hughes, Sr. ..... 404/10
6,935,574 B2 * 8/2005 Cheng ..... 238/10 B
7,228,813 B2 * 6/2007 Flamingo et al. ..... 116/63 C
2004/0151543 A1 * 8/2004 Mettler et al. ..... 404/9
2006/0124642 A1 * 6/2006 Karow et al. ..... 220/62

* cited by examiner

*Primary Examiner*—Raymond W Addie
(74) *Attorney, Agent, or Firm*—Rabin & Berdo, P.C.

(57) ABSTRACT

A traffic cone counterweight structure, the base of the cone is preformed with a large-diameter opening at the center having a convex ring member of proper width at its mid-section along the inner edge. A plurality of dovetail through holes are annularly configured along the circumference of the opening of base at where it adjoins the convex ring member. The preformed base is placed in an existing mold for making an integrally-formed traffic cone for injection molding of cone body. The better fluidity material that is used for the cone body flows through the preformed dovetail through holes on the base to wrap around the convex ring member to conjoin the base and the cone body.

5 Claims, 5 Drawing Sheets

TRAFFIC CONE COUNTERWEIGHT STRUCTURE

BACKGROUND OF THE INVENTION

1. Field of the Invention

The present invention relates to a traffic cone counterweight structure designed primarily for saving the production cost of traffic cones. The traffic cone is made by first fabricating its base and then forming the cone body by injection molding. As such, the base of traffic cone can be made of materials with less fluidity or recycled material, or even scrap material from waste tires by stamping and extruding, thereby reducing the material cost of the base without compromising the original warning effect of the traffic cone and its counterweight requirement. Also, the production of such traffic cones can use existing molds for making integrally-formed traffic cones directly without the need to fabricate a separate mold, hence offering excellent utilization value and economic benefit for the industry.

2. Description of the Related Art

Conventional traffic cones are made of plastic or rubber material in one piece by injection molding. A traffic cone generally comprises a cone body and a base at the bottom, where the base enhances its upright stability, while the cone body provides the warning effect. With such a structural design, the cone body uses a reflective material, which reflects the light from automobile headlights at nighttime to enhance the warning effect. For the upright stability of the traffic cone, its base incorporates different counterweights to address the varying needs on different occasions and the regulatory requirements for road signs in different areas.

Such an integrally-formed traffic cone is made of a single material and confined in terms of shape. Because its cone body is thinner and bigger in size, only materials with better fluidity can be used to make sure the material will fill the mold during a limited time in the process of injection molding. Also to achieve a better reflection effect, the production of traffic cone must use better quality material, blended with phosphors for injection molding, without the option of using lower-grade or recycled material. As a result, the production cost of traffic cones stay high. On the other hand, if cost is a prime consideration and material with poor fluidity is used for injection molding, the cone body tends to break or results in defects during molding, which leads instead to material waste. In addition, traffic cones have a counterweight requirement, which poses a considerable technical challenge in the production process. Thus the traffic cones disclosed in U.S. Pat. No. 6,929,419 and U.S. Pat. No. 7,056,055 are designed to have the cone body and base fabricated separately, in which the cone body is first made by injection molding and then placed in the base mold. When the base is formed, it wraps around the cone body. To make sure the cone body and the base are securely coupled to each other, the cone body is provided with an annular enclosure at its bottom, on which through-holes or upright bars are disposed. By placing the annular enclosure at the bottom of cone body in the base mold, the material used for the formation of base will flow through the through-holes and wraps around the annular enclosure to lock with the cone body through the upright bars and through-holes, thereby enhancing their coupling strength. Also, to address varying counterweight requirements, molds of different specifications can be used to fabricate bases with varying counterweights and thicknesses to meet the specific requirements for traffic cones.

The design of fabricating the cone body and base in separate processes as disclosed in the aforementioned patents solves the base counterweight problem. But in those patents, thermofusible material with better fluidity must be used for the fabrication of base in order for the material to flow through the through-holes and upright bars disposed on the annular enclosure of cone body and wrap around the annular enclosure snugly. Generally materials with better fluidity cost more. As such, the aforementioned patents effectively address the counterweight issue of traffic cone, but tend to jack up its production cost, thus lacking utilization value and economic benefit, and leaving room for improvement.

Also in the aforementioned patents, the cone body of a traffic cone is first formed by injection molding and then placed in the base mold to produce a base that wraps around the cone body. As such, existing molds for traffic cones are of no use, while separate molds for the cone body and the base have to be fabricated. In addition, the thickness of the base must vary to meet different counterweight specifications, while the height of upright bars on the cone body must match the height of the base. Under the circumstances, traffic cone manufacturers must make separate molds for the cone body and base with different counterweight specifications, which greatly increases the mold cost. In fact, the increase in cost far surpasses the saving achieved by using low-priced material, hence lacking economic benefit. Moreover, when making traffic cones with different counterweight specification, the mold needs to be changed and calibrated, which is time consuming, thereby adversely affecting the production efficiency. Thus the design for traffic cones mentioned above is hardly ideal.

SUMMARY OF THE INVENTION

In view of the problems and drawbacks present in the prior art, this inventor embarked on research with the aim to improve the existing traffic cone structure, and based on many years of experience and know-how in the industry, developed a traffic cone counterweight structure disclosed in the present invention. The primary object of the present invention is to allow the base and the cone body of a traffic cone to be fabricated in separate processes and allow the use of low-price material for making the base of traffic cone without compromising the warning effect and weight requirement of traffic cones, thereby achieving savings in material cost and greatly enhancing its utilization value and economic benefit.

Another object of the present invention is to allow the use of an existing mold for making an integrally-formed traffic cone, where the base is preformed and then placed in the mold for the making of cone body by injection molding. Manufacturers only need to fabricate different base molds to meet different counterweight requirements, and use the existing movable die blocks of mold for making integrally-formed traffic cone to assemble traffic cones of different counterweights. As such, the mold costs are reduced significantly, and there is no time-consuming and tedious operation of mold change in order to produce traffic cones with different counterweights, thereby greatly enhancing the production efficiency and offering excellent economic benefit.

Yet another object of the present invention is that through structural design, it allows the use of material with less fluidity or recycled material for the making of the base of the traffic cone, or even the use of scrap material, such as waste tire, to make the base of traffic cone by stamping and extruding, thereby achieving the dual economic benefits of waste recycling and reuse, and cost reduction.

To achieve the aforesaid objects, the structural design of the present invention calls for fabricating the traffic cone in separate processes, in which, the base is first preformed, and then assembled to the cone body by injection molding, so that material possessing less fluidity or recycled material, or even scrap material, such as waste tire, can be used to fabricate the base by injection molding or stamping and extruding. As such, the material cost for the base is reduced without adversely affecting the warning effect and weight requirement of the traffic cone. Moreover, the existing mold for making integrally-formed traffic cone is used directly for the fabrication of traffic cone without the need to make additional molds, thereby offering excellent utilization value and economic benefit.

DETAILED DESCRIPTION OF THE PREFERRED EMBODIMENT

The structural composition, technical means and effects of the invention are described in detail below with embodiments in reference to the accompanying drawings.

Figure 2:
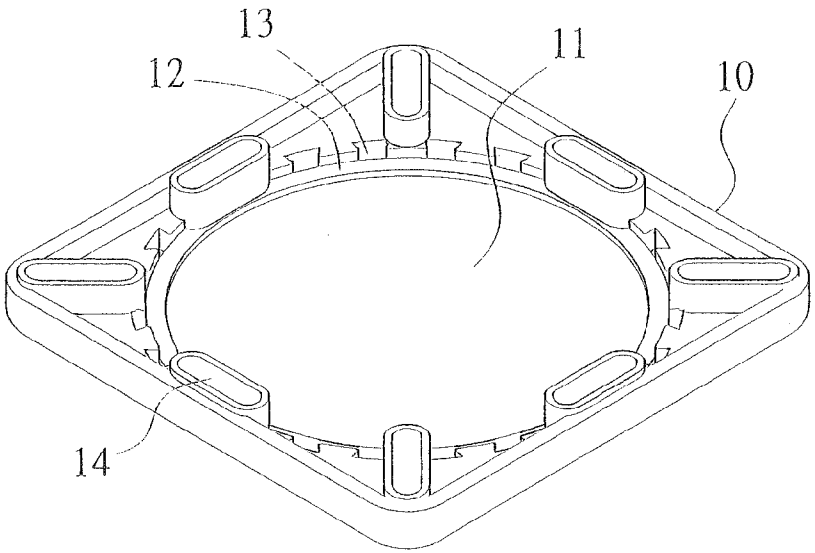
FIG. 2 is a structural diagram of the traffic cone base according to a preferred embodiment of the invention viewed from another side.
Figure 1:
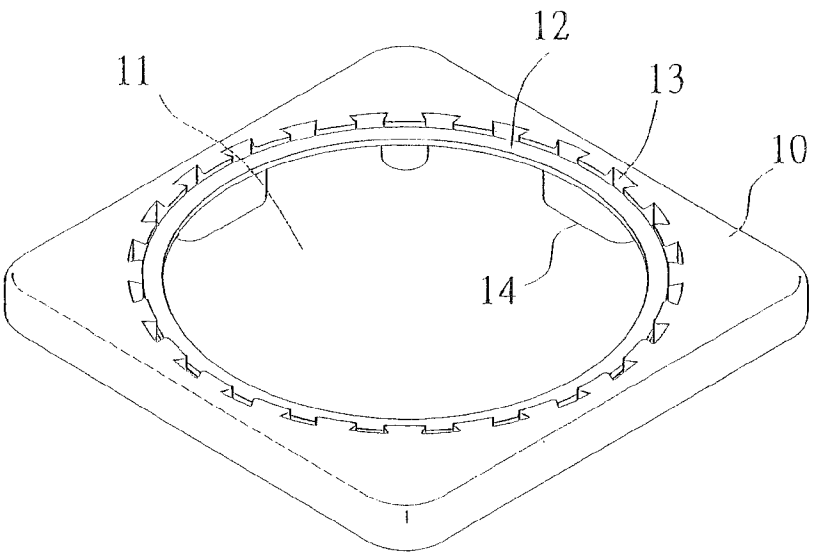
FIG. 1 is a structural diagram of the traffic cone base according to a preferred embodiment of the invention.
Figure 3:
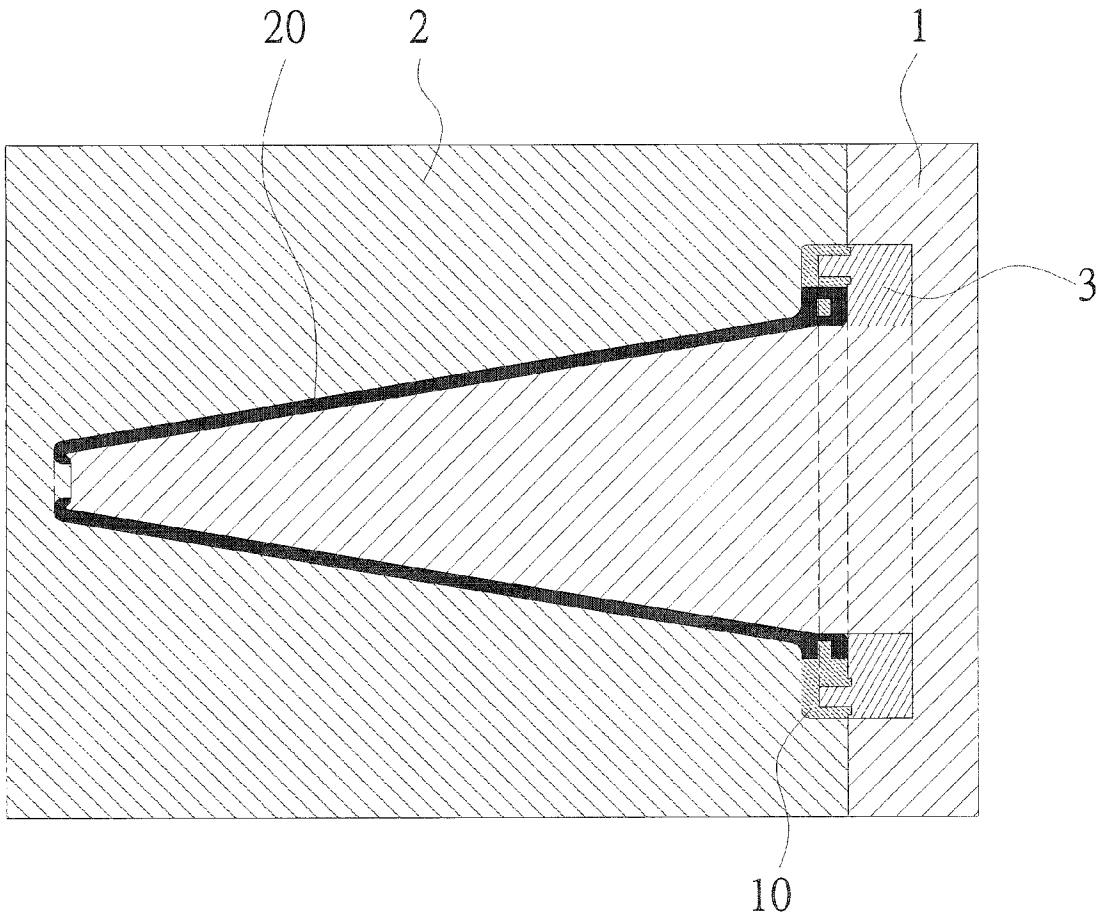
FIG. 3 is a structural relations diagram of an assembled traffic cone according to a preferred embodiment of the invention.
Figure 4:
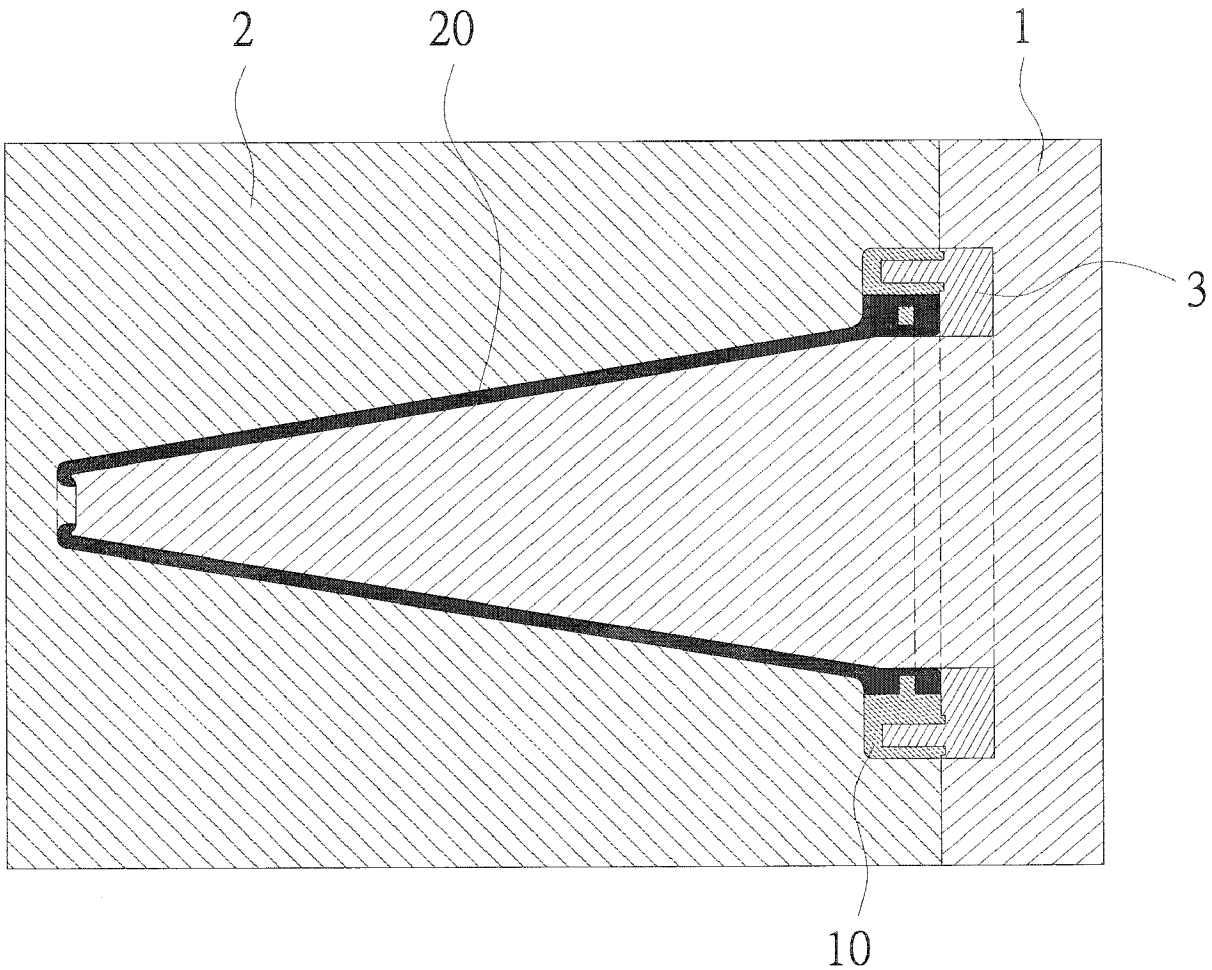
FIG. 4 is a structural relations diagram of an assembled traffic cone according to another preferred embodiment of the invention.
Figure 5:
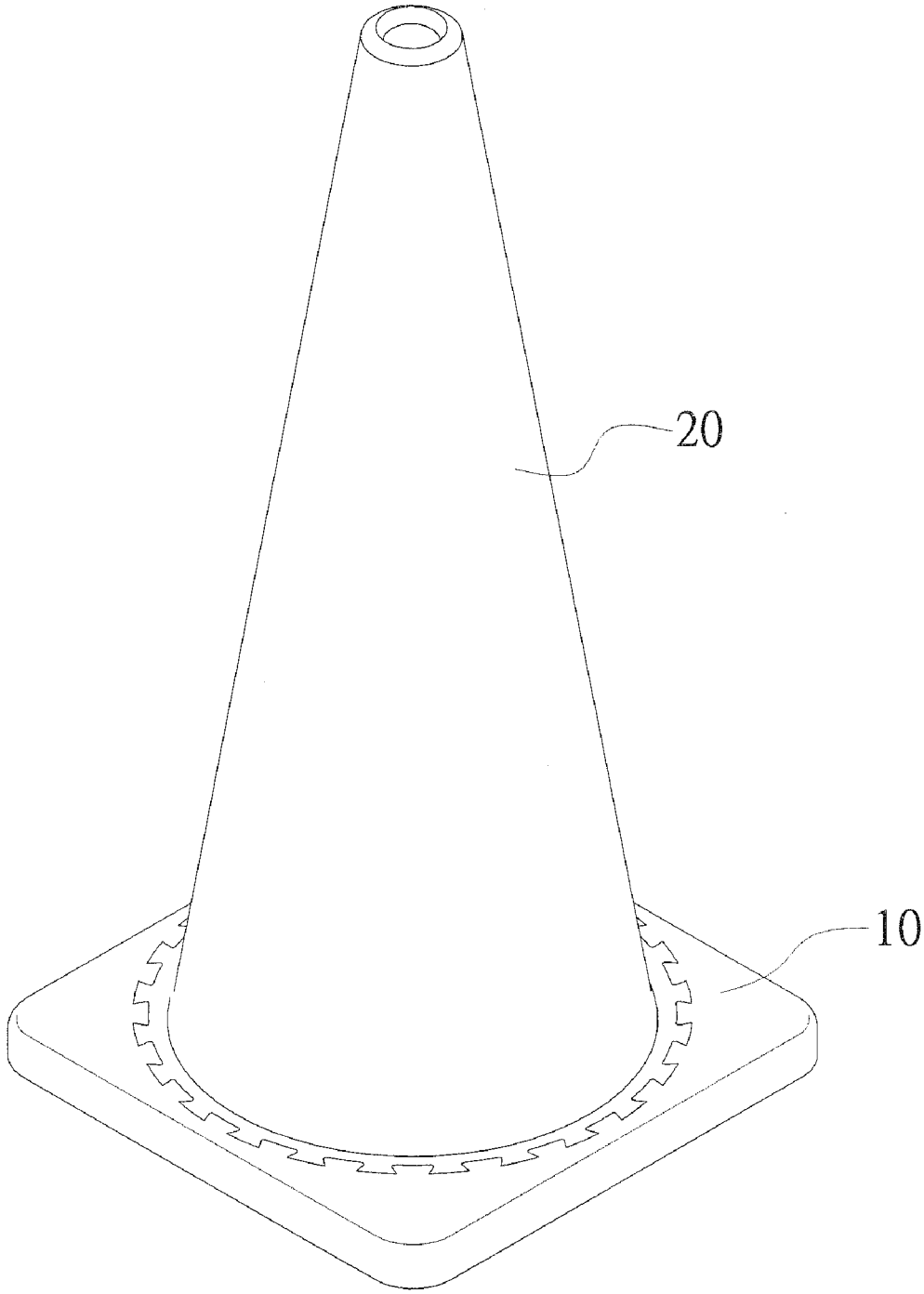
FIG. 5 is a structural diagram of a traffic cone according to a preferred embodiment of the invention.
Figure 6:
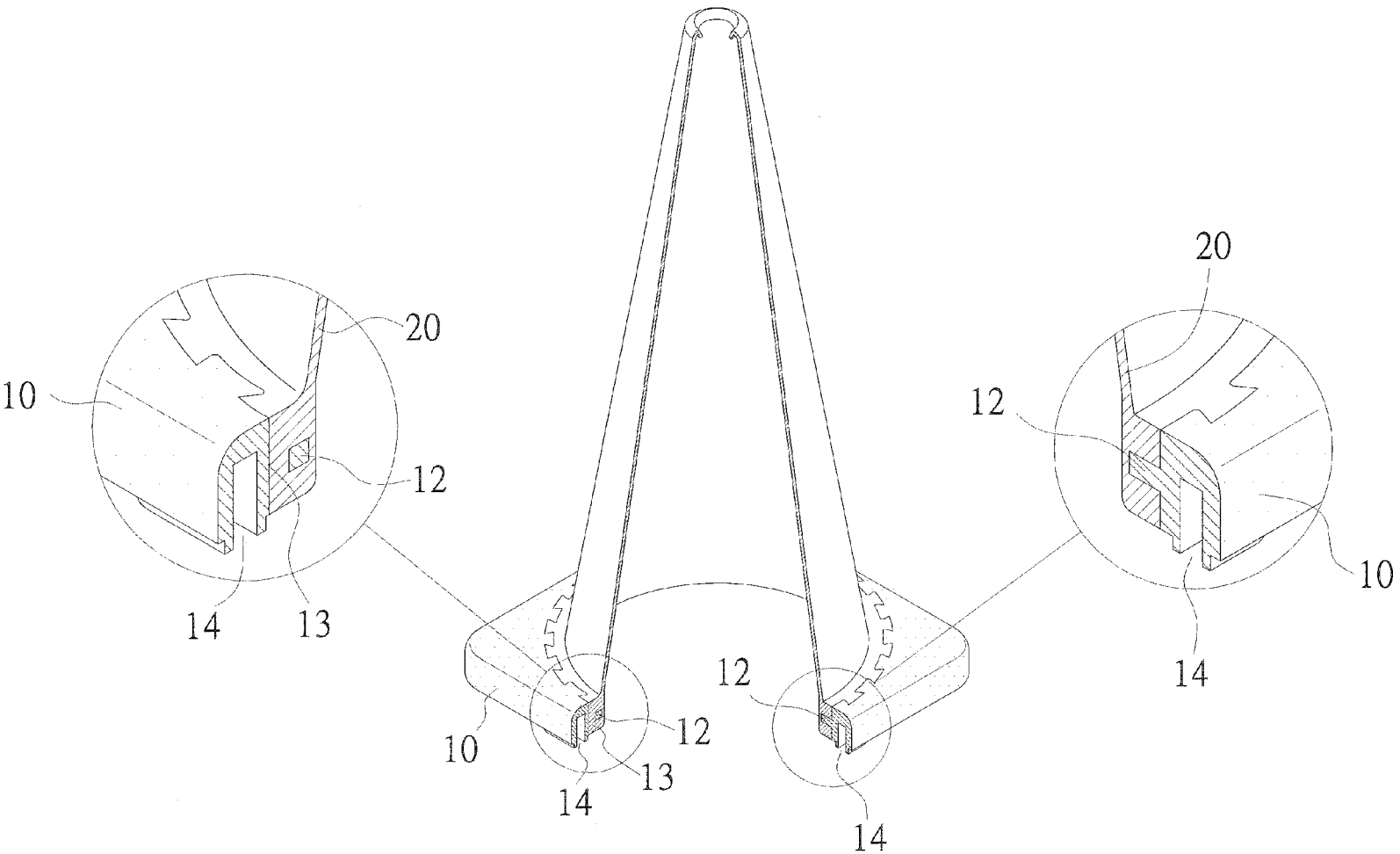
FIG. 6 is a structural relations diagram of a traffic cone according to a preferred embodiment of the invention.

Referring to the structural diagrams in FIGS. 1, 2 and 5, the assembly structural relations diagrams in FIGS. 3 and 4, and the structural relations diagram in FIG. 6, the structural design for a preferred embodiment of the invention calls for fabricating the base 10 and the cone body 20 of a traffic cone in separate processes, wherein the base 10 is preformed, and then placed in a traffic cone mold for the injection molding of cone body 20.

Based on actual needs, separately fabricated base molds can be used to make bases with various counterweight configurations. There is provided a large-diameter opening 11 at the center of the base 10 for coupling the cone body 20 in an injection molding process. The mid-section along the inner edge of the opening 11 is extendedly disposed with a convex ring member 12 of proper width, a plurality of dovetail through holes are annularly configured along the circumference of opening 11 of base 10 at where it adjoins the convex ring member 12, and a plurality of positioning slots 14 are preformed on the bottom surface of base 10. The base 10 with such construction is then placed in the movable mold base 1 for molding the integrally-formed traffic cone. The die blocks 3 assembled in the movable mold base 1 and coupled to the positioning slots 14 on the bottom surface of base 10 help lock the base 10 in place. Subsequently, the movable mold base 1 closes over the fixed mold plate 2, and material with better fluidity is fed into the mold for the injection molding of cone body 20. As the material flows through the preformed dovetail through holes on the base onto the upper and lower sides of convex ring member 12 and wraps around it, and with the presence of dovetail through holes 13, the interlocking between the base 10 and cone body 20 is made stronger without the need to worry about base 10 being detached from the cone body 20. As such, a traffic cone is assembled and finished.

In the traffic cone disclosed above, the base 10 is preformed and then attached to the cone body by injection molding. Because the cone body 20 is injection molded with material possessing better fluidity, the quality and warning effect of the traffic cone are not affected. On the other hand, the base 10 of the traffic cone is not required to provide any warning function, and its main function is to provide counterweight functionality to enhance the upright stability of traffic cone. In addition, base 10 is wrapped by the material used for cone body 20. Thus it can be made of material with less fluidity, or recycled material by injection molding, or even scrap material, such as waste tire by stamping and extruding. As a result, the material cost of base 10 can be reduced significantly. As the base 10 is wrapped by material with better fluidity used in the injection molding of cone body 20, the molds required for the fabrication of traffic cone are moderately simplified, while the production process complexity and costs are greatly reduced without adversely affecting the basic warning effect of traffic cone. Overall, the disclosed traffic cone process offers excellent utilization value and economic benefit.

Moreover, the traffic cone of the invention has its base 10 preformed, which is then placed in an existing mold for making integrally-formed traffic cone to become attached to the cone body 20 in an injection molding process. In the whole fabrication process, manufacturers only need to prepare base molds for making bases 10 that meet varying counterweight requirements. It is not necessary to make a new mold for the injection molding of cone body 20. Base molds are smaller in size and volume, and hence are less costly. The changing of the base mold is also easier. More importantly, there is no need to switch the traffic cone mold during the production of traffic cones of same size and different counterweight. It is only necessary to change the movable die blocks 3 attached to the movable mold base 3 based on the counterweight specification of base 10 and position the base 10 in place, and then use the fixed mold 2 to injection mold the cone body 20 to produce a traffic cone of desired specifications and counterweight. This fabrication process disclosed herein does not incur extra mold costs for making cone bodies and bases of varying specifications as disclosed in the aforementioned patents, which feature the process of making cone body by injection molding and then wrapping around the base. In addition, the process disclosed herein does not involve tedious mold change operation, thereby achieving real cost reduction.

The fabrication of the traffic cone according to the present invention is a departure from the approach of first using injection molding to create the cone body and then attaching the cone body to the base by injection molding as disclosed in the aforementioned patents. Instead, the present invention places a preformed base in the mold for making the cone body by injection molding. As such, the cone body maintains its quality and warning effect, while the base has more options in terms of material used that it is possible to use lower cost material with less fluidity or recycled material for the injection molding of base, or use scrap material such as waste tire to make the base by stamping and extruding. In addition, the base can have different counterweight configurations. By using the existing mold for making integrally-formed traffic cone and changing its movable die blocks, manufacturers can produce traffic cones having the same specifications but varying counterweight. In comparison with the traffic cones disclosed in the aforementioned patents that incur tremendous mold costs to meet different counterweight requirements, the present invention offers more economic benefit in terms of industrial application. In addition, the present invention does not require frequent changes of the mold which is a tedious operation. Thus the whole process is made more agile and possesses greater utilization value.

To sum up, the improved design of traffic cone counterweight structure disclosed in the present invention can effectively cut down the production cost of traffic cone, and effectively address the number of problems and drawbacks observed in the prior art. The present invention is an outstanding innovative design and hereby applies for the grant of patent.

What is claimed is:

1. A traffic cone counterweight structure, comprising:

a base serving as a counterweight and having an opening at a center thereof, the opening being defined by a circumferential upright wall, the base further having a ring disposed midway up the wall, the ring projecting inwardly and from the wall so as to form a step, the base further having a plurality of dovetail-shaped through holes annularly configured along a circumference of the opening where the ring member adjoins the wall; and a cone body having a plurality of dovetail-shaped interlocking members which engage with the respective dovetail-shaped through holes.

2. The traffic cone counterweight structure as in claim 1, wherein said cone body further engages with the ring member.

3. The traffic cone counterweight structure as in claim 1, wherein said cone base is made from recycled materials.

4. The traffic cone counterweight structure as in claim 1, wherein the base and the cone body are integrally formed.

5. The traffic cone counterweight structure as in claim 1, wherein the structure is made from waste tire by stamping and extruding.

* * * * *